US006102876A

United States Patent [19]

Winger

[11] Patent Number: 6,102,876

[45] Date of Patent: Aug. 15, 2000

[54] HAND HELD MASSAGER

[76] Inventor: Dale R. Winger, P.O. Box 1136, Monticello, Ind. 47960

[21] Appl. No.: 08/863,474

[22] Filed: May 27, 1997

[51] Int. Cl.[7] ..... A61H 15/00

[52] U.S. Cl. ..... 601/135; 601/107; 601/137; D24/211; D24/214

[58] Field of Search ..... 601/107, 108, 601/110, 134–8, 118–121, 125, 128, 129, 131; D24/211, 214, 215

[56] References Cited

U.S. PATENT DOCUMENTS

| | | | |
|---|---|---|---|
| D. 249,551 | 9/1978 | Greenawalt | D24/211 |
| D. 258,687 | 3/1981 | Katsube | D24/211 |
| D. 272,649 | 2/1984 | Bloch | D24/211 |
| D. 317,204 | 5/1991 | Henneseey | D24/211 |
| D. 351,658 | 10/1994 | Beckman | D24/211 |
| 744,718 | 11/1903 | Cassidy | 601/131 |
| 1,724,842 | 8/1929 | Kazmazyk | 601/137 |
| 3,831,592 | 8/1974 | Lancellotti | 601/135 |
| 4,648,387 | 3/1987 | Simmons | 601/120 |
| 5,577,996 | 11/1996 | Gardner et al. . | |

*Primary Examiner*—Danton D. DeMille

[57] ABSTRACT

The invention disclosed is a hand held massager comprising a rod with movable contact element mounted on the rod and a pair of contacts fixed at the opposite ends of the rod. The contact elements may be used to engage the body in a number of different ways while at least one contact is held and manipulated by a user.

7 Claims, 2 Drawing Sheets

FIG. 3
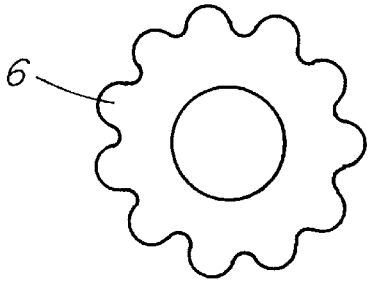
FIG. 4
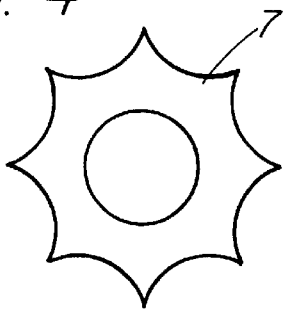
FIG. 5
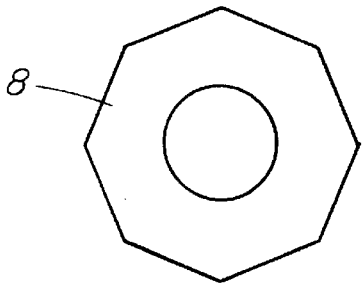
FIG. 6
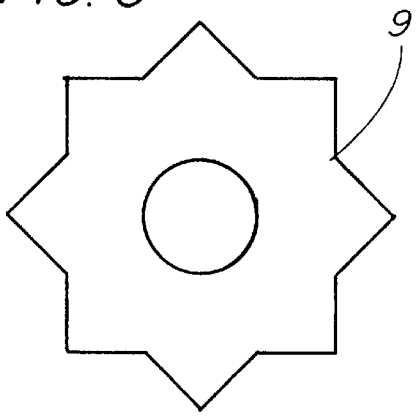
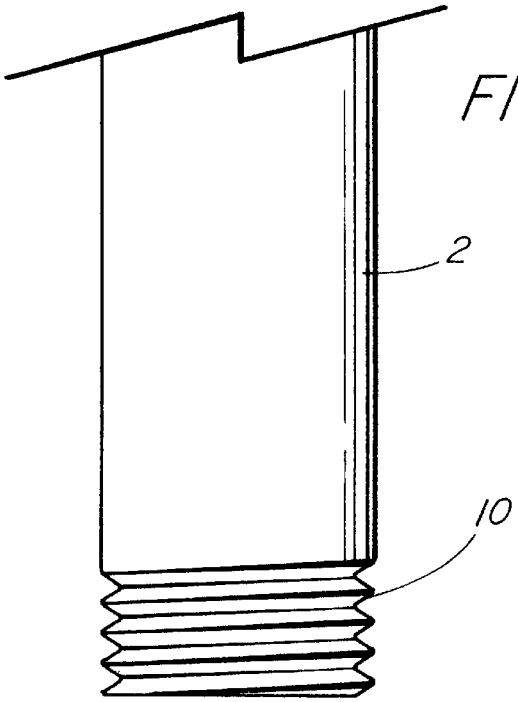
FIG. 7

HAND HELD MASSAGER

BACKGROUND OF THE INVENTION

Massaging the human body can be a valuable form of therapeutic relief. A professional is often employed because of that person's knowledge of the muscles of the body and that person's ability to apply controlled pressure for some determined amount of time. A lay person, having available an instrument, which, when used properly can achieve much of the same psychic and muscle tension relaxing results as can the professional.

However, the prior device with which I am familiar all have drawbacks. For instance, some self-massage devices are actually pieces of furniture with electrically driven moving parts. Others, electrically powered, are capable only of a single type of action. Some are simply vibrators, while others can only impart a kind of rubbing motion. The hand held devices in the prior art that I am aware of, are for imparting a single motion and include either a rolling surface or a kind of rubbing surface.

In addition the hand held massagers that I am familiar with are usually held in one hand and a user may, and frequently does become fatigued when using the device and stops the use before the desired beneficial result is achieved.

Therefore, it is an object of this invention to provide a novel hand held massager that is simple to operate but at the same time may be operated in a number of different ways to provide a variety of massaging effects.

It is another object of this invention to provide a novel hand held massager which, by virtue of its' construction, can be used with either one hand or two hands, so that the person using it is subject to less fatigue and therefore will be disposed to use it longer.

A further object of this invention is to provide a novel had held massager that may contact the body with a number of different surfaces and motions and so achieve a number of different effects.

A still further object of this invention is to provide a novel hand held massager that is simple in construction, with only one moving part, and that may be formed from a variety of materials.

These and other objects are achieved by my invention. The structure and some of its' various modes of operation may be understood by reference to the drawing taken in conjunction with the detailed description.

BRIEF DESCRIPTION OF THE DRAWINGS

FIG. 3 is an end view of another embodiment of a grasping or contact element of the invention;

FIG. 4 is an end view of still another embodiment of such a contact or grasping element of the invention;

FIG. 5 is an end view of one more embodiment of a contact or grasping element of the invention;

FIG. 6 is a view of still one more embodiment of a contact or grasping element of the invention; and FIG. 7 illustrates an end of the rod forming a part of the invention threaded to engage complimentary threads (not shown) in contact or grasping element of the invention.

DETAILED DESCRIPTION

Figure 1:
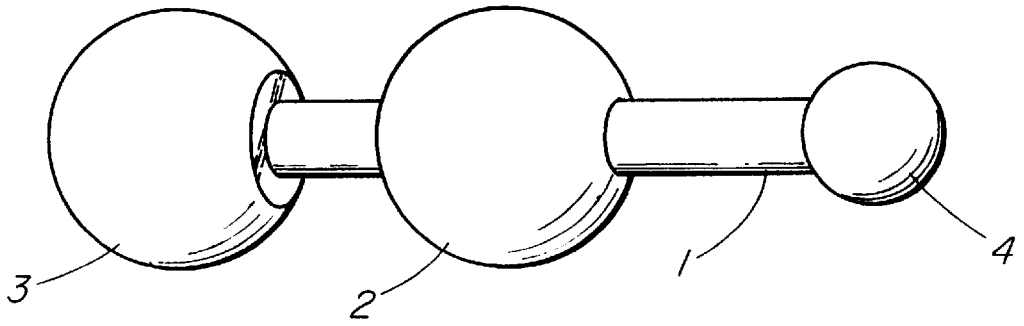
FIG. 1 is a plan view of an embodiment of the invention.

Referring first to FIG. 1 it may be seen that the invention in one form consists of four elements. The first is a rod 1 that in this embodiment is round in cross section. Provided with a center hole so that it is movable on the rod, is a contact element in the form of a sphere 2. Mounted on opposing ends of the 1 are other contact elements, spheres 3 and 4. As illustrated, the spheres 2 and 3 are of the same size while the sphere 4 is relatively smaller. This is by way of exemplification only, for all dimensions may be varied by a designer using as a basic criterion, the need for the massager to be comfortably held and manipulated by a human.

Figure 2:
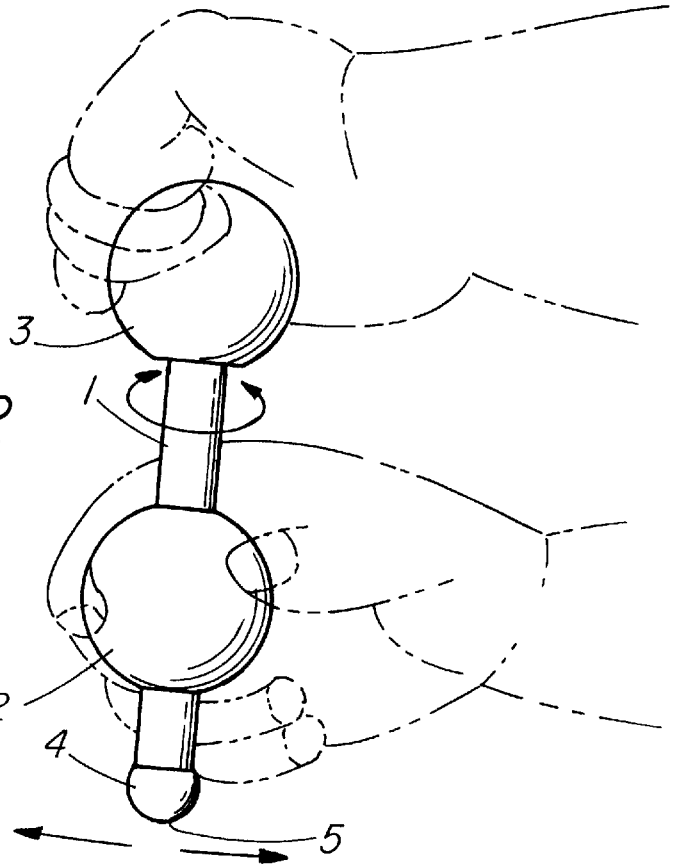
FIG. 2 is an illustration of how an embodiment of the invention may be grasped by human hands and manipulated to engage, move over and thereby massage a human body.

With reference to FIG. 2, seen in a user's hand is a massager according to the invention. This drawing illustrates the preferred size of any version of the invention by showing it in relation to the size of what might be a typical human hand. As may be seen, one hand is grasping the large sphere 3 and giving it a twisting or "pepper grinder" motion. The large sphere 2 in this mode of use is held by the thumb and index finger so that it acts as a bearing surface for the rod 1, allowing the rod to rotate so that the small sphere 4 rotates in turn. In this way the energy imparted by the user's hand as it rotates is transferred to the small sphere 4 in the form of a circular motion. Downward pressure may be applied by the user so that at the point of impact with the body, indicated by reference numeral 5, a complex of motions designated by the arrows may be applied by the user.

Another way the invention can be used is for the user to hold only sphere 2 and place the contact point 5 on the body and move the massager back and forth while permitting the sphere 4 to roll across the body.

Alternatively, the sphere 2 may be engaged by one hand with the spheres 3 and 4 in contact with the body. As the user's hand is rotated the spheres 3 and 4 will rotate over the body and with the sphere 2 in contact with the body, the rod 1 may be moved back and forth in the sphere 2, thus increasing the area of body massaged.

Other modes of use may occur to users, depending on which sphere is held and how they are manipulated.

Additionally, (as shown in FIGS. 3 through 6) versatility is added by varying the shape of the spheres or contacting or grasping elements. Each of these figures illustrate different cross-section possibilities for these elements. FIG. 3 shows a scalloped outer surface 6. Such a surface permits a series of contacts with the body. FIG. 4 is a device having a number of cusps which may be used to gently knead the body. The series of flat surfaces of FIG. 5 permit a succession of contacts while the pointed projections 9 of FIG. 6 may function somewhat in the manner of the cusps of FIG. 4. The contact or grasping elements need not be circular in cross section but may be oval or egg shaped or some other shape as chosen by a designer.

The contact or grasping elements 3 and 4 may be attached to the rod 1 using any suitable means, such as an adhesive or force fit. Alternatively, the rod may be provided with a threaded end such as is shown at 10 in FIG. 7 and the elements 3 and 4 with complimentary internal threads so that a user may change them as desired.

A massaging device according to this invention may be made using any number of suitable materials and manufacturing techniques, such as molding plastic or shaping wood. It is intended by the claims appended hereto to cover all the variations and modifications as all others that come within their scope.

What is claimed as new and desired to be secured by Letters Patent is:

1. A hand held massager consisting of a rod; a pair of spherical contact elements for massaging the body fixed to opposite ends of said rod so as to rotate therewith; a spherical contact element for massaging the body having a center hole through which said rod passes and dimensioned to permit said spherical contact element to rotate on said rod and to be slideable there along between the pair of contact elements and to contact with the pair of contact elements.

2. The hand held massager of claim 1 wherein the outer periphery of at least one of said pair of contact elements has an outer surface formed with a plurality of cusps thereon.

3. The hand held massager of claim 1 wherein at least one of said contact elements is formed with a plurality of rounded surfaces on its' periphery.

4. The hand held massager of claim 1 wherein at least one of said contact elements is formed with a plurality of flat surfaces at its' periphery.

5. The hand held massager of claim 1 wherein at least one of said contact elements is formed with a plurality of points extending from its' periphery.

6. The hand held massager of claim 1 wherein at least one end of said rod has threads formed on the end thereof to engage into at least one of said contact elements.

7. The hand held massager of claim 1 wherein said spherical contact element is provided with an opening therein through which said rod passes.

* * * * *